US006146081A

United States Patent [19]

Anderson

[11] Patent Number: 6,146,081

[45] Date of Patent: Nov. 14, 2000

[54] MULTI-TINE LIFTING IMPLEMENT

[76] Inventor: Deloren Edward Anderson, Rte. 3, Box 94A, Crosby, Minn. 56441

[21] Appl. No.: 09/053,101

[22] Filed: Apr. 1, 1998

[51] Int. Cl.[7] ..... B67C 01/00

[52] U.S. Cl. ..... 414/685; 414/722; 37/405

[58] Field of Search ..... 414/685, 722, 414/723; 37/405

[56] References Cited

U.S. PATENT DOCUMENTS

| | | | |
|---|---|---|---|
| 2,574,045 | 11/1951 | Lapham . | |
| 2,675,139 | 4/1954 | Mercier et al. . | |
| 2,744,644 | 5/1956 | Hackney et al. . | |
| 3,214,041 | 10/1965 | Walberg | 37/405 |
| 3,288,316 | 11/1966 | West | 414/685 |
| 3,362,554 | 1/1968 | Fortier | 37/405 |
| 3,387,731 | 6/1968 | Gibson et al. . | |
| 3,790,013 | 2/1974 | Smith . | |
| 3,916,669 | 11/1975 | Schmidt et al. . | |
| 4,239,446 | 12/1980 | Vucinic . | |
| 4,257,732 | 3/1981 | Staffanson | 414/685 |
| 4,355,947 | 10/1982 | Wiblin . | |
| 4,579,501 | 4/1986 | Fox . | |
| 4,790,717 | 12/1988 | Anderson . | |
| 4,903,418 | 2/1990 | Loudon | 414/722 |
| 5,190,437 | 3/1993 | Perry | 414/722 |
| 5,263,811 | 11/1993 | Teffer | 414/619 |
| 5,564,885 | 10/1996 | Staben, Jr. . | |
| 5,575,608 | 11/1996 | Yau et al. . | |

FOREIGN PATENT DOCUMENTS

| | | |
|---|---|---|
| 2 359 067 | 2/1978 | France . |

*Primary Examiner*—Gregory A. Morse
*Attorney, Agent, or Firm*—Merchant & Gould P.C.

[57] ABSTRACT

The present invention relates to a multi-tine lifting implement, which, when mounted on a vehicle such as a skid steer loader, can pry and lift objects such as concrete or asphalt slabs or pavement, pieces of concrete or asphalt, rocks, shrubs, small trees, and the like.

38 Claims, 5 Drawing Sheets

MULTI-TINE LIFTING IMPLEMENT

BACKGROUND OF THE INVENTION

Many different devices are available for lifting and moving materials such as pieces of concrete or asphalt, trees or shrubs, and the like. Vehicles of various kinds can be used to manipulate these moving and lifting devices for prying, pushing, lifting, moving, and releasing such materials. In certain situations it is desirable to pry, lift and/or move larger materials, such as chunks of concrete, a tree with its root ball, or a stump, while sifting out smaller materials, such as gravel and soil. For example, when breaking up a concrete or asphalt pavement, it is typically desired to leave the underlayment in place for resurfacing. When uprooting a tree, shrub or stump, either for transplantation or removal, it is often desirable to leave much of the surrounding soil at the original site of the tree, shrub, or stump.

A variety of lifting and moving attachments are available for a vehicle such as a skid steer loader. One typical attachment is a bucket that can be used for digging, prying and lifting an object. Typical buckets lack length useful for gaining leverage in prying and have sides that prevent the bucket from being pushed a useful distance under, for example, a concrete slab. Furthermore, a bucket retains all material scooped, no matter its size. Pallet forks are useful for picking up objects with a wide, flat, and even base, but are not suited for penetrating beneath, prying and lifting a tree or pavement. Various devices for digging or grasping trees are not suitable for other general lifting and prying purposes.

There remains a need for an implement that can be attached to a vehicle such as a skid steer loader and that is suitable for lifting and prying, and allowing smaller objects to fall or be shaken out of the implement.

SUMMARY OF THE INVENTION

The invention includes a multi-tine lifting implement that can be mounted on a vehicle, such as a skid steer loader, having arms or another apparatus for moving multi-tine lifting implement up and down and/or for tilting the multi-tine lifting implement relative to the ground. The multi-tine lifting implement includes a coupling system for connecting to the arms, or other implement support system, of the vehicle. The coupling system can be a component of a support member, which supports a tine system. The tine system includes a plurality of tines having a blade that extends laterally from a proximal end along a lower edge of the support system to a distal end. The tines extend from the proximal to the distal end and define voids allowing the tine system to support rocks, pieces of concrete or asphalt, a root ball of a tree or shrub, or the like without holding smaller objects. Preferably, the implement includes a member for stabilizing the tines against undesirable lateral or torsional movement.

DETAILED DESCRIPTION OF THE INVENTION

The invention is now described with respect to the embodiments shown in FIGS. 1–5.

The present invention relates to an implement, which, when mounted on a vehicle, typically a loader such as a skid steer loader, a track loader, a wheel loader, or the like, can pry and lift objects such as concrete or asphalt slabs or pavement, pieces of concrete or asphalt, rocks, shrubs, small trees, and the like. Typically, the implement is mounted on arms or another apparatus for moving the implement up and down and for tilting the implement relative to the ground. A multi-tined lifting implement employs a plurality of tines which are advantageous for inserting beneath the object to be pried or lifted providing a narrow cross section that encounters reduced resistance from the material under the object to be pried or lifted and which have a length advantageous for providing leverage in prying and lifting. The tines are configured advantageously for prying and lifting larger objects and allowing smaller objects to fall or be shaken out of the implement. Typically, a multi-tined lifting implement includes a support member which couples the implement to and supports the implement on a vehicle, such as a skid steer loader, and supports the tine system. The tine system includes three or more tines which project forward from the support member and are spaced for prying and lifting objects such as trees, shrubs, rocks, and pieces or slabs of concrete or pavement, but allowing smaller objects to fall between the tines. The multi-tined lifting implement also, preferably, includes one or more side members for retaining an object on the tine system during prying, lifting, and transport operations.

Figure 1:
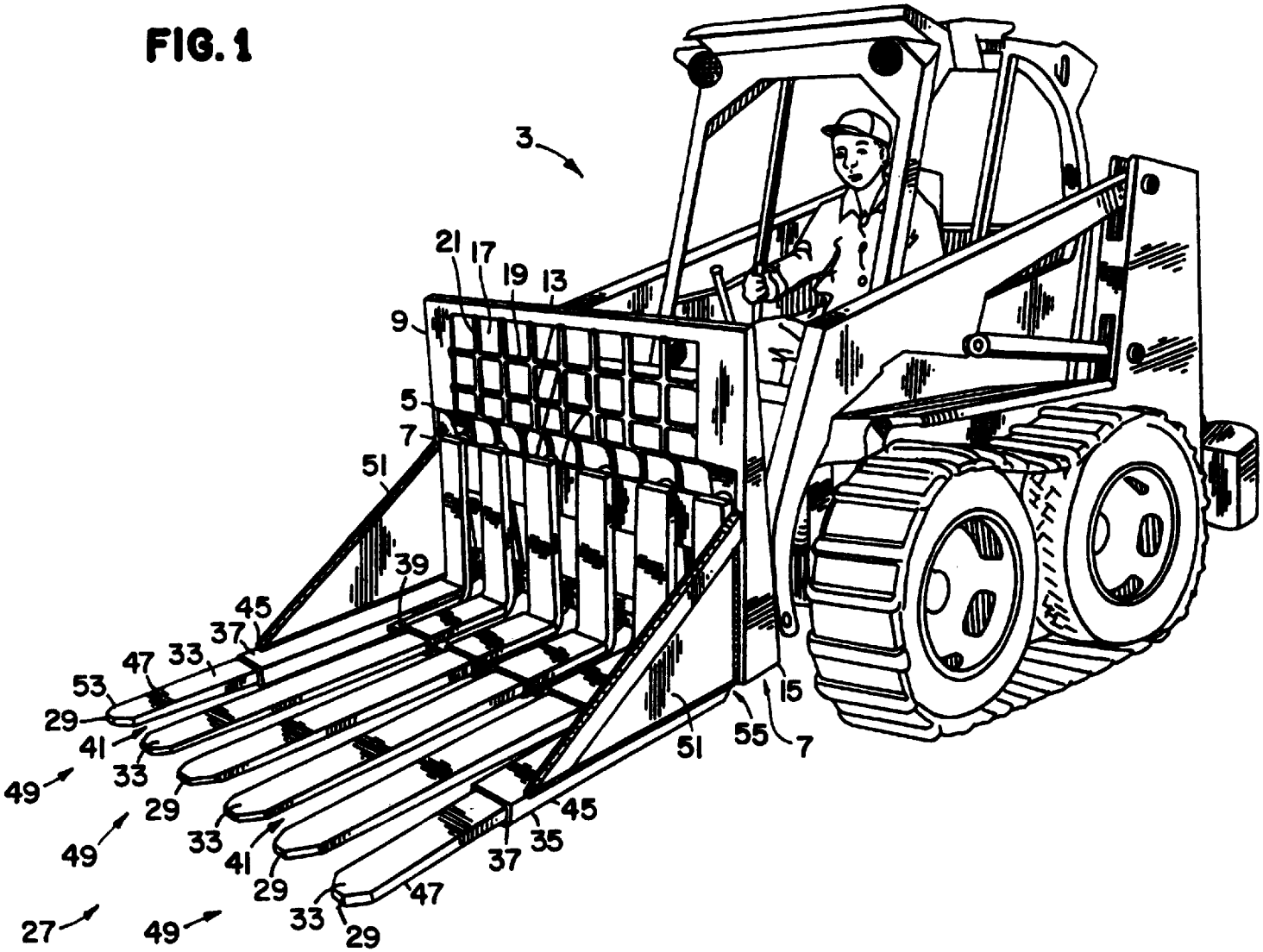
FIG. 1 illustrates a front right perspective view of a preferred embodiment of the present multi-tine lifting implement mounted on a skid steer loader.
Figure 2:
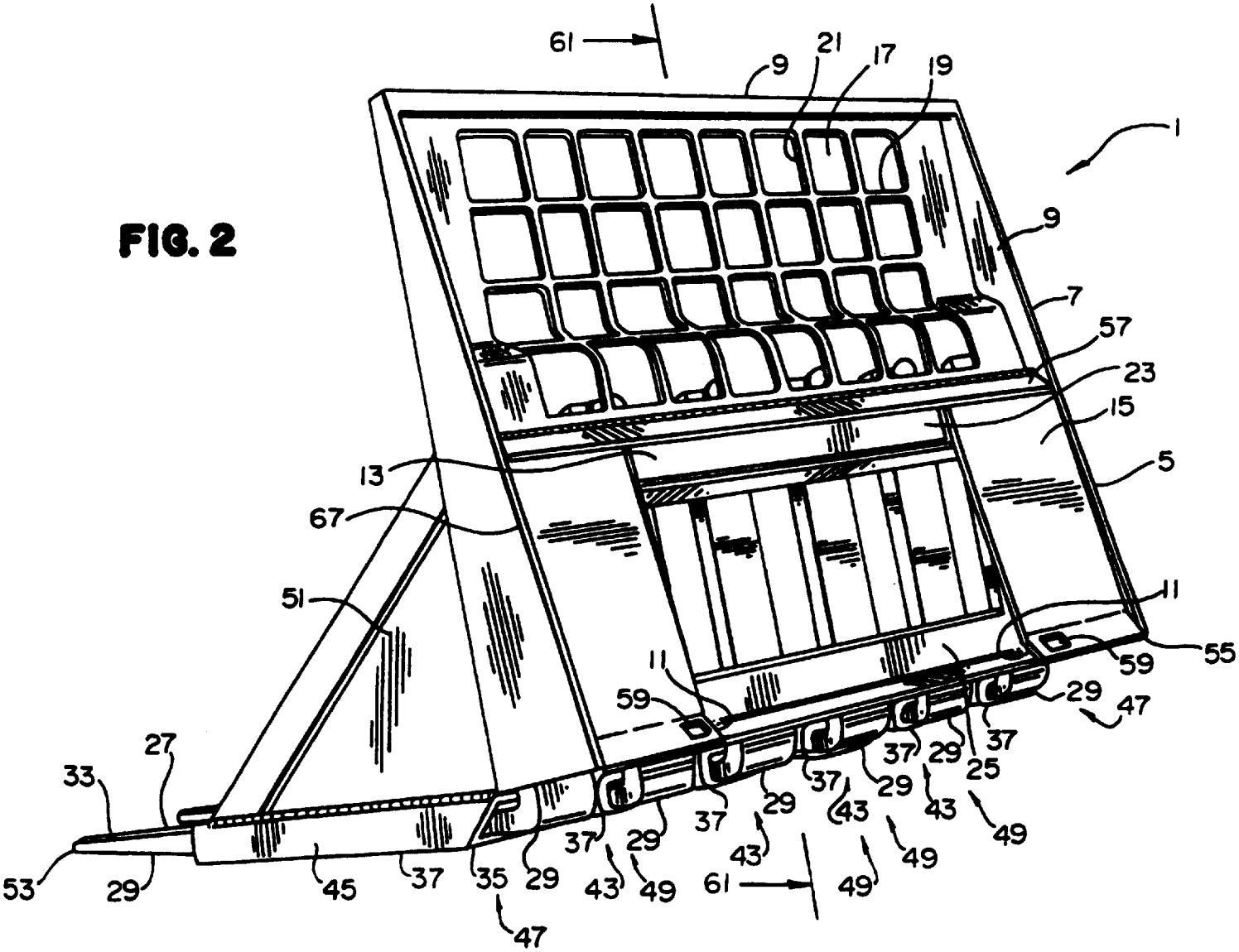
FIG. 2 illustrates a rear left perspective view of a preferred embodiment of the present multi-tine lifting implement.

Referring now to the Figures, FIGS. 1 and 2 show a multi-tine lifting implement 1 according to one embodiment of the invention. In FIG. 1, multi-tine lifting implement 1 is coupled to a skid steer loader 3 by a coupling system 5 known in the art for mounting implements on skid steer loader 3 and sometimes referred to as a quick attach. As illustrated, coupling system 5 includes a flange 57 on support member 7 and openings 59 defined by support member 7. Flange 7 is oriented at an acute angle from support member 7 and in a generally downward direction. A front plate on skid steer loader 3 fits up under flange 57 and is securely coupled, for example by latches, clamps, dogs, or pins that engage support member 7 through openings 59. Openings 59 are typically defined by beveled plate member 67 of coupling system 5 and support member 7.

A variety of mechanisms are known in the art for coupling an implement to a vehicle such as a loader and, in one or more embodiments, multi-tine lifting implement 1 can include a coupling system 3 suitable for coupling to each such mechanism. For example, skid steer loaders and like vehicles can include as standard equipment one of several known coupling systems for mounting implements on the loader, and multi-tine lifting implement 1 can include any of several known designs of coupling system 3 for coupling to these known vehicle coupling systems. Some loaders, in particular heavier loaders, employ for coupling to an implement one or more arm holes on the end of the each arm that lifts and/or tilts the implement. Each arm hole corresponds to a hole defined by a rearward facing tab, a tab hole, on the implement, a pin and, typically, a sleeve fits through the arm hole and tab hole and is retained in these holes by, for example, a pin. Coupling system 3 can include an arrangement of tabs and tab holes for coupling to such loaders.

Figure 3:
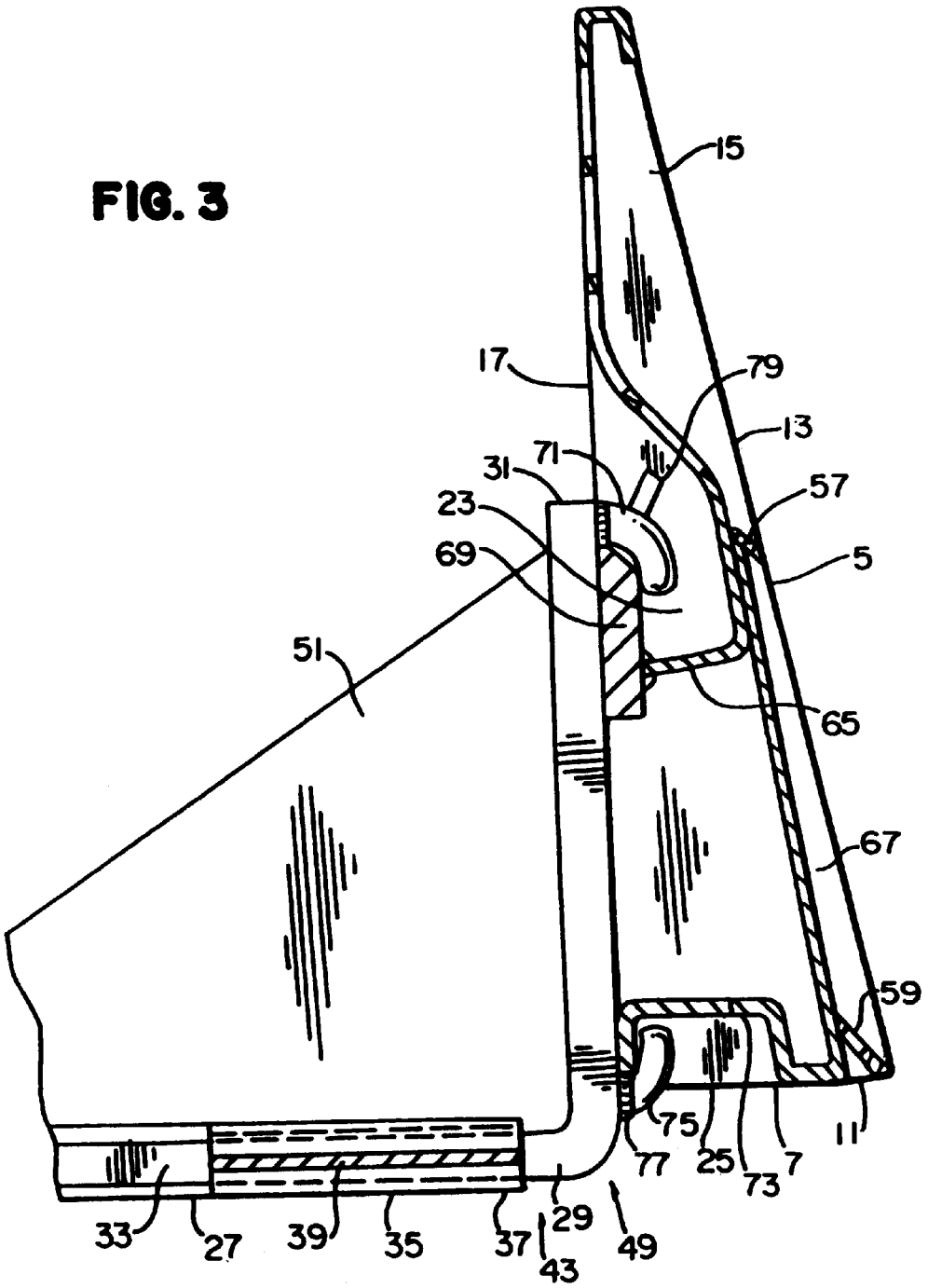
FIG. 3 illustrates a schematic cross sectional view of a preferred embodiment of the present multi-tine lifting implement, the cross section taken along cutting line 61 in FIG. 2.
Figure 4:
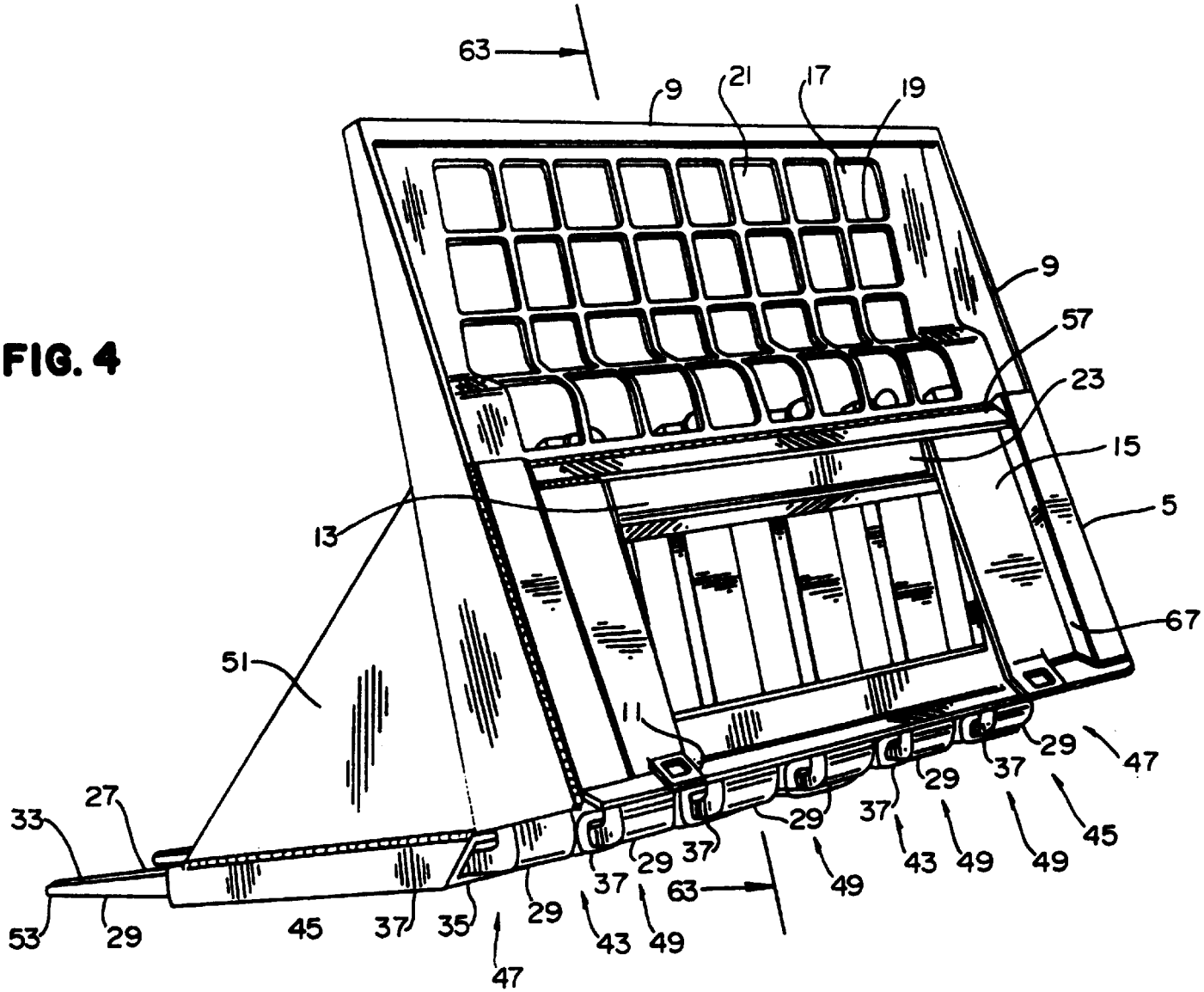
FIG. 4 illustrates a rear left perspective view of an alternate preferred embodiment of the present multi-tine lifting implement.
Figure 5:
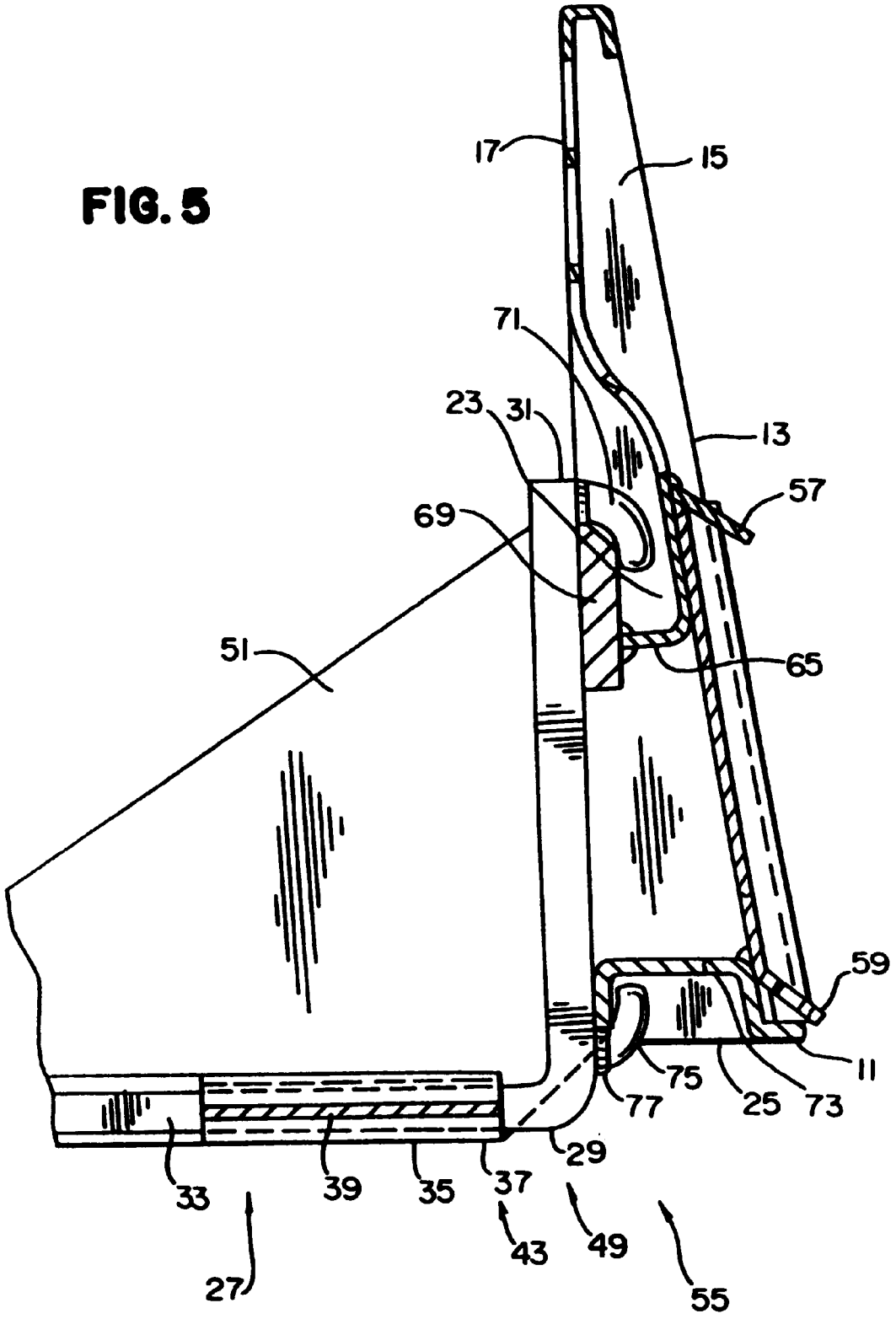
FIG. 5 illustrates a schematic cross sectional view of an alternate preferred embodiment of the present multi-tine lifting implement, the cross section taken along cutting line 63 in FIG. 4.

Referring now to FIGS. 2 and 3, these figures illustrate an embodiment of support member 7. Support member 7 is a generally upright member which includes coupling system 5 and is adapted and configured for supporting tine system 27. Tine system 27 is typically supported by one or more tine system supports, for example upper tine system support 23 and lower tine system support 25. Support member 7 includes two or more vertical members 15 that are coupled to and provide support for upper tine system support 23 and lower tine system support 25. In the embodiment shown in the Figures, vertical members 15, upper tine support system 23, and lower tine support system 25 define a generally rectangular member and the width of multi-tine lifting implement 1. Upper tine system support 23 includes a generally rearwardly depending portion 65 that is coupled, typically by welding, both to flange 57 and to beveled plate member 67. Lower tine system support 25 is also coupled, typically by welding, to beveled plate member 67.

Support member 7 can also include a grid 17, which may provide additional strength to support member 7 but serves primarily a safety function of preventing objects lifted or pried by multi-tine lifting implement 1 from falling on an operator of the vehicle. Vertical members 15 can extend to form frame 9 having a generally rectangular or square configuration and also including upper horizontal member 13. Grid 17 includes horizontal grid members 19 and vertical grid members 21, and occupies an area within frame 9 and bounded by upper horizontal member 11, two vertical members 15, and an upper tine system support 23. Upper tine system support 23 is coupled to vertical members 15 and is generally parallel to upper horizontal member 13. Lower tine system support 25 is coupled to two vertical members 15; is generally parallel to upper horizontal member 13 and upper tine system support member 23.

Upper tine system support 23 and lower tine system support 25 are adapted and configured to support a tine system 27. Upper tine system support 23 includes a bar portion 69 extending laterally across implement 1 and configured to receive a top hook 71 of tine 29. Bar portion 69, in the embodiment illustrated, is beveled in a rearward direction for engaging and retaining top hook 71 and for bearing load imposed by the weight and operation of tine 29. Top hook 71 is generally concave downward and, typically, extends nearly across the width of tine 29. Bar portion 69 can include recesses for retaining hook 71 from lateral motion along bar portion 69. Hook 71 can include a cam or lever 79 for pressably engaging bar 69 and stabilizing hook 71 on bar 69.

Lower tine system support 25 includes a beam 73 extending laterally across implement 1 and configured to receive bottom hook 75. Bottom hook 75 is generally concave upward and, typically, extends nearly across the width of tine 29. Bottom hook 75 receives an edge 77 of beam 73. Beam 73, in the embodiment illustrated, has a dipper or S-shaped cross section which provides strength and engages bottom hook 75. Bottom hook 75 and lower tine system support 25 are configured for retaining tine 29 from lateral motion and from forward motion, and also for bearing load imposed during operations such as prying with tine 29. Beam 73 is coupled to and provides support for coupling plate member 67.

A variety of mechanisms are known in the art for supporting tines or another type of implement on a vehicle such as a loader and, in one or more embodiments, multi-tine lifting implement 1 can include a support member 7 suitable for each such mechanism. For example, skid steer loaders and like vehicles can include as standard equipment one of several known support members for mounting tines on the loader, and multi-tine lifting implement 1 can include any of several known designs of support member 7 for coupling to these known vehicle systems. For example, one or more tines 29 can be supported on one or more generally horizontal rods, one of which can serve as an upper tine system support 23 and another can serve as a lower tine system support 25. Numerous systems are known in the art for supporting tines on fork lifts and the like, and such systems can be employed for supporting tines 29 of multi-tine lifting implement 1 and can be adapted for use on a loader. In addition various hook type carriage assemblies are known in the art for forks employed on cargo-handling lift trucks and can be employed in multi-tine lifting implement 1 to provide support for tine system 27.

Tine 29 is typically L-shaped and includes post member 31 and blade 33. Post member 31 includes a securing arrangement, such as upper hook 71 and bottom hook 75, for coupling or attaching tine 20 to support member 7. Blade 33 is generally elongated and flat, which presents a small cross section advantageous for sliding under an object to be pried or lifted. Blade 33 extends laterally from a proximal end along a lower edge of the support system to a distal end. Blade configurations for a tine for a lifting apparatus are known in the art and are suitable for use with tines of the present invention. Tine 26 can be any of a variety of tines known for use on a cargo-handling lift truck and like vehicles. Typically, tine 26 is made of a hard steel.

Tine system 27 includes a plurality of tines 29 spaced to allow multi-tine lifting implement 1 to retain large objects such as chunks of cement or asphalt, trees or shrubs, stumps or the like, and for smaller objects, such as gravel, soil, and the like, to fall through. Multi-tine lifting implement 1 includes three or more tines 29, preferably about three to about seven tines 29, preferably about five to about six tines 29. Tine system 27 is advantageously configured for prying and lifting larger objects, such as chunks or slabs of pavement or cement and the like, and allowing smaller objects to fall or be shaken out of multi-tine lifting implement 1. Tine system 27 can include a plurality of generally parallel and coplanar tines 29 that project forward from support member 7. Typically, adjacent tines define a void 41 between them of about one to about eighteen inches, preferably about two to about five inches, preferably about three inches.

The flat cross section presented by tine system 27 is advantageous for providing a wide lifting member that presents an advantageously small cross section to material to be penetrated to pry or lift an object. This is in contrast to an implement which employs teeth mounted edgewise to increase the strength of the teeth, but which provides a larger number of teeth than tines and a resulting increase in the cross sectional area that must penetrate the material under an object for prying or lifting. This increase in cross section disadvantageously requires increased power to insert the teeth under the object.

Tine system 27 can also include stabilizing member 35 which restricts movement of tine 29 with respect to support member 7 and to retains tines 29 in a generally parallel orientation. Movement of tine 29, such as twisting, lifting, sliding, and the like, relative to support member can cause unacceptable wear on components of multi-tine lifting implement 1, such as upper and lower tine system supports 23 and 25, respectively, and the like. Stabilizing member 35 prevents or reduces such harmful movement of tine 29. Stabilizing member 35 includes one or more sleeves 37 and one or more spanning members 39. Sleeve 37 fits over blade 33 of tine 29. Spanning member 39 spans void 41 between tines 29 to couple a plurality of sleeves 37 to form a generally rigid stabilizing member 35. Sleeve 37 preferably fits over tine 29 with a gap between tine 29 and sleeve 37. For example, sleeve 37 can be made from square tubing dimensioned slightly larger than the tine. Advantageously, sleeve 37 is not welded or otherwise coupled to tine 29 to provide advantageous shock absorbing and a small degree of flexibility in movement of the tines. Preferably, each sleeve 37 and/or spanning member 39 is coupled to support member 7.

Preferably, stabilizing member 35 includes one or more interior sleeves 43 and two edge sleeves 45. Edge sleeve 45 can fit over an edge tine 47 (a tine on an outermost edge) of tine system 27 and extends farther in a forward direction (is longer) than interior sleeve 43. Advantageously, edge sleeve 45 provides additional stability to a outermost tine and is coupled to side member 51. Typically edge sleeve 45 is about twice as long as interior sleeve 43. Interior sleeve 43 fits over interior tine 49.

Multi-tine lifting implement 1 includes one or more, preferably two, side members 51. Each side member 51 extends upward from edge tine 47 or from edge sleeve 45 on either edge of the implement and extends forward from the support member. The side member is arranged and configured for preventing objects from falling off of tine system 27 and provides support for tine system 27. Side member 51 can be a solid plate as shown, for example, in FIGS. 1 and 2, or can be a strap or bar that defines a side of a void between edge tine 47 or edge sleeve 45, support member 7 and side member 51.

Typically multi-tine lifting implement 1 is mounted on a vehicle, such as a skid steer loader, having arms or another apparatus for moving multi-tine lifting implement 1 up and down and/or for the tilting multi-tine lifting implement 1 relative to the ground. The orientation of the multi-tine lifting implement 1 changes as the vehicle or its arms are manipulated by the operator. For inserting under an object, tine 29 blades 33 of tine system 27 are generally horizontal or parallel to the ground with support member 7 generally vertical or perpendicular to the ground. For prying an object from the ground, the tine 29 blades 33 can be angled with a distal end 53 lower than a proximal end 55 and, advantageously, employ movement of the vehicle for applying prying force. Tines 29 are advantageous for prying, compared to existing attachments, due to the ability of a loader or like vehicle to exert greater force in tilting that for lifting. In addition, the force of the vehicle moving can provide additional force. For further prying and loosening of the object to be lifted, force can be applied to move distal end 53 upward relative to the proximal end 55. For lifting the object from the ground, distal end 53 can be raised relative to proximal end 55, see for example FIG. 5, to cup the object in a void formed by tine system 27, support member 7, and side members 51. Alternatively, the lifted object can lay on the generally horizontal tine 29 blades 33 (see FIG. 6) and, if necessary, can be retained on the tine system 27 by one or more side members 51.

In the construction of the multi-tine lifting implement components can be coupled, attached or fused by any method suitable for components of a lifting implement for use on a vehicle such as a skid steer loader. As used herein, coupling attaching or fusing a component of the multi-tine lifting implement to another component of the multi-tine lifting implement refers to such methods and includes joining components with one or more welds, a brazed joint, one or more rivets, one or more bolts, one or more screws, and the like. As used herein, terms such as upper, lower, downward, upward, vertical, horizontal, left, right, and the like are used in association with the accompanying figures in a relative sense and solely for purposes of clarity of description. It will be understood by one of skill in the art that, in use, the multi-tine lifting implement can assume a variety of orientations. As used herein, the phrases "pried or lifted", "prying or lifting", "pry or lift" and variants on these phrases refer to conducting either or both of these operations, either sequentially (in either order) or simultaneously.

The present invention is applicable to a number of different multi-tine lifting implements and methods employing them. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art upon review of the present specification. The claims are intended to cover such modifications and devices.

What is claimed is:

1. A multi-tine lifting implement comprising:

a support member, a tine system, and one or more side members;

the support member being adapted and configured for coupling the lifting implement to a vehicle and for supporting the tine system;

the tine system comprising a three or more generally parallel and coplanar tines, each tine being generally L-shaped and including a post member and a blade, each tine blade comprising a major surface and a minor surface, the major surface defining a flat cross section and projecting forward from the support member, adjacent tines defining a void therebetween; the flat cross section of the tine blades forming a coplanar array and a tine system having a flat cross section; and each side member extending upward from a tine on an edge of the implements extending forward from the support member, and being arranged and configured for retaining objects on the tine system.

2. The implement of claim 1, wherein the vehicle is a skid steer loader, track loader, or a wheel loader.

3. The implement of claim 1, further comprising a stabilizing member, the stabilizing member being adapted and configured to retain the tines in a generally parallel orientation and comprising a plurality of sleeves, each sleeve being adapted and configured for fit over a tine, and a plurality of spanning members, each spanning member spanning a void between adjacent tines and coupling two sleeves.

4. The implement of claim 3, wherein the stabilizing member comprises one or more edge sleeves.

5. The implement of claim 1, wherein the support member comprises:

a frame, a grid, a mounting member, an upper tine system support, and a lower tine system support;

the frame comprising a rigid generally rectangular configuration comprising a first vertical member, a second vertical member, an upper horizontal member, and a lower horizontal member, each vertical member being coupled to each horizontal member and each horizontal member being coupled to each vertical member;

the grid comprising one or more horizontal grid members and one or more vertical grid members and occupying an area within the frame and bounded by the upper horizontal member, the two vertical members, and the upper tine system support;

the upper tine system support being coupled to each vertical member, being generally parallel to upper horizontal member and lower horizontal member, and being adapted and configured for supporting one or more tines; the lower tine system support being coupled to each vertical member, being generally parallel to the upper horizontal member, the lower horizontal member, and the upper tine system support member, and being adapted and configured for supporting one or more tines; and the mounting member being adapted and configured for coupling the implement to a vehicle.

6. The implement of claim 1, wherein the tine comprises a generally L-shaped configuration of an upwardly extending post, a forwardly extending blade, and a securing arrangement coupling the tine to the support member, the securing arrangement being coupled to the post.

7. The implement of claim 1, wherein the side member comprises a generally triangular plate coupled to a tine and a vertical member.

8. The implement of claim 3, wherein the stabilizing member comprises a plurality of sleeves, each sleeve configured to fit over a segment of a tine, the sleeves being coupled in a configuration in which each of the plurality of sleeves fits over a tine and in which the configuration of sleeves is generally perpendicular to the support member.

9. The implement of claim 3, wherein the stabilizing member comprises a middle sleeve and an edge sleeve, the edge sleeve extending along the blade for the length of the side member.

10. The implement of claim 5, wherein the frame comprises a rigid generally square configuration.

11. A multi-tine lifting implement comprising:

a support member, a tine system, and one or more side members;

the support member being adapted and configured for coupling the lifting implement to a vehicle and for supporting the tine system; the support member comprising a frame, a grid, a mounting member, an upper tine system support, and a lower tine system support;

the frame comprising a rigid generally rectangular configuration comprising a first vertical member, a second vertical member, an upper horizontal member, and a lower horizontal member, each vertical member being coupled to each horizontal member and each horizontal member being coupled to each vertical member;

the grid comprising one or more horizontal grid members and one or more vertical grid members and occupying an area within the frame and bounded by the upper horizontal member, the two vertical members, and the upper tine system support;

the upper tine system support being coupled to each vertical member, being generally parallel to upper horizontal member and lower horizontal member, and being adapted and configured for supporting one or more tines; the lower tine system support being coupled to each vertical member, being generally parallel to the upper horizontal member, the lower horizontal member, and the upper tine system support member, and being adapted and configured for supporting one or more tines; and the mounting member being adapted and configured for coupling the implement to a vehicle;

the tine system comprising a three or more generally parallel and coplanar tines, each tine being generally L-shaped and including a post member and a blade, each tine blade projecting forward from the support member and comprising a major surface and a minor surface, the major surface defining a flat cross section, adjacent tines defining a void therebetween; the flat cross section of the tine blades forming a coplanar array and a tine system having a flat cross section; and each side member extending upward from a tine on an edge of the implement, extending forward from the support member, and being arranged and configured for retaining objects on the tine system.

12. The implement of claim 11, wherein the vehicle is a skid steer loader, track loader, or a wheel loader.

13. The implement of claim 11, further comprising a stabilizing member, the stabilizing member being adapted and configured to retain the tines in a generally parallel orientation and comprising a plurality of sleeves, each sleeve being adapted and configured for fit over a tine, and a plurality of spanning members, each spanning member spanning a void between adjacent tines and coupling two sleeves.

14. The implement of claim 13, wherein the stabilizing member comprises one or more edge sleeves.

15. The implement of claim 11, wherein the tine comprises a generally L-shaped configuration of an upwardly extending post, a forwardly extending blade, and a securing arrangement coupling the tine to the support member, the securing arrangement being coupled to the post.

16. The implement of claim 11, wherein the side member comprises a generally triangular plate coupled to a tine and a vertical member.

17. The implement of claim 13, wherein the stabilizing member comprises a plurality of sleeves, each sleeve configured to fit over a segment of a tine, the sleeves being coupled in a configuration in which each of the plurality of sleeves fits over a tine and in which the configuration of sleeves is generally perpendicular to the support member.

18. The implement of claim 13, wherein the stabilizing member comprises a middle sleeve and an edge sleeve, the edge sleeve extending along the blade for the length of the side member.

19. The implement of claim 5, wherein the frame comprises a rigid generally square configuration.

20. A multi-tine lifting implement comprising:

a support member, a tine system, and one or more side members;

the support member being adapted and configured for coupling the lifting implement to a vehicle and for supporting the tine system;

the tine system comprising a three or more generally parallel and coplanar tines, each tine comprising a blade, each tine blade comprising a major surface and a minor surface, the major surface defining a flat cross section and projecting forward from the support member, adjacent tines defining a void therebetween; the flat cross section of the tine blades forming a coplanar array and a tine system having a flat cross section; and each side member extending upward from a tine on an edge of the implement, extending forward from the support member, and being arranged and configured for retaining objects on the tine system.

21. The implement of claim 20, wherein the vehicle is a skid steer loader, track loader, or a wheel loader.

22. The implement of claim 20, further comprising a stabilizing member, the stabilizing member being adapted and configured to retain the tines in a generally parallel orientation and comprising a plurality of sleeves, each sleeve being adapted and configured for fit over a tine, and a plurality of spanning members, each spanning member spanning a void between adjacent tines and coupling two sleeves.

23. The implement of claim 22, wherein the stabilizing member comprises one or more edge sleeves.

24. The implement of claim 20, wherein the support member comprises:

a frame, a grid, a mounting member, an upper tine system support, and a lower tine system support;

the frame comprising a rigid generally rectangular configuration comprising a first vertical member, a second vertical member, an upper horizontal member, and a lower horizontal member, each vertical member being coupled to each horizontal member and each horizontal member being coupled to each vertical member;

the grid comprising one or more horizontal grid members and one or more vertical grid members and occupying an area within the frame and bounded by the upper horizontal member, the two vertical members, and the upper tine system support;

the upper tine system support being coupled to each vertical member, being generally parallel to upper horizontal member and lower horizontal member, and being adapted and configured for supporting one or more tines; the lower tine system support being coupled to each vertical member, being generally parallel to the upper horizontal member, the lower horizontal member, and the upper tine system support member, and being adapted and configured for supporting one or more tines; and the mounting member being adapted and configured for coupling the implement to a vehicle.

25. The implement of claim 21, wherein each tine comprises a generally L-shaped configuration.

26. The implement of claim 25, wherein the tine comprises a generally L-shaped configuration of an upwardly extending post, a forwardly extending blade, and a securing arrangement coupling the tine to the support member, the securing arrangement being coupled to the post.

27. The implement of claim 20, wherein the side member comprises a generally triangular plate coupled to a tine and a vertical member.

28. The implement of claim 22, wherein the stabilizing member comprises a plurality of sleeves, each sleeve configured to fit over a segment of a tine, the sleeves being coupled in a configuration in which each of the plurality of sleeves fits over a tine and in which the configuration of sleeves is generally perpendicular to the support member.

29. The implement of claim 22, wherein the stabilizing member comprises a middle sleeve and an edge sleeve, the edge sleeve extending along the blade for the length of the side member.

30. The implement of claim 24, wherein the frame comprises a rigid generally square configuration.

31. A lifting system comprising a skid steer loader and a multi-tine lifting implement, the multi-tine lifting implement comprising:

a support member, a tine system, and one or more side members;

the support member being adapted and configured for coupling the lifting implement to a vehicle and for supporting the tine system;

the tine system comprising a three or more generally parallel and coplanar tines, each tine being generally L-shaped and including a post member and a blade, each tine blade comprising a major surface and a minor surface, the major surface defining a flat cross section and projecting forward from the support member, adjacent tines defining a void therebetween; the flat cross section of the tine blades forming a coplanar array and a tine system having a flat cross section; and each side member extending upward from a tine on an edge of the implement, extending forward from the support member, and being arranged and configured for retaining objects on the tine system.

32. The system of claim 31, wherein the implement further comprises a stabilizing member, the stabilizing member being adapted and configured to retain the tines in a generally parallel orientation and comprising a plurality of sleeves, each sleeve being adapted and configured for fit over a tine, and a plurality of spanning members, each spanning member spanning a void between adjacent tines and coupling two sleeves.

33. The system of claim 32, wherein the stabilizing member comprises one or more edge sleeves.

34. The system of claim 31, wherein the support member comprises:

a frame, a grid, a mounting member, an upper tine system support, and a lower tine system support;

the frame comprising a rigid generally rectangular configuration comprising a first vertical member, a second vertical member, an upper horizontal member, and a lower horizontal member, each vertical member being coupled to each horizontal member and each horizontal member being coupled to each vertical member;

the grid comprising one or more horizontal grid members and one or more vertical grid members and occupying an area within the frame and bounded by the upper horizontal member, the two vertical members, and the upper tine system support;

the upper tine system support being coupled to each vertical member, being generally parallel to upper horizontal member and lower horizontal member, and being adapted and configured for supporting one or more tines; the lower tine system support being coupled to each vertical member, being generally parallel to the upper horizontal member, the lower horizontal member, and the upper tine system support member, and being adapted and configured for supporting one or more tines; and the mounting member being adapted and configured for coupling the implement to a vehicle.

35. The system of claim 31, wherein the side member comprises a generally triangular plate coupled to a tine and a vertical member.

36. The system of claim 32, wherein the stabilizing member comprises a plurality of sleeves, each sleeve configured to fit over a segment of a tine, the sleeves being coupled in a configuration in which each of the plurality of sleeves fits over a tine and in which the configuration of sleeves is generally perpendicular to the support member.

37. The system of claim 32 wherein the stabilizing member comprises a middle sleeve and an edge sleeve, the edge sleeve extending along the blade for the length of the side member.

38. The system of claim 34, wherein the frame comprises a rigid generally square configuration.

* * * * *